US006497016B1

(12) United States Patent
Lin

(10) Patent No.: US 6,497,016 B1
(45) Date of Patent: Dec. 24, 2002

(54) STRUCTURE OF ZIPPER SLIDE FOR INVISIBLE ZIPPER

(76) Inventor: Yu-Pau Lin, No. 151, Kung Erh Road, Wu Lin Tsuen, Lung Tan Hsiang, Tao Yuan Hsien (TW)

( * ) Notice: Subject to any disclaimer, the term of this patent is extended or adjusted under 35 U.S.C. 154(b) by 0 days.

(21) Appl. No.: 09/883,282

(22) Filed: Jun. 19, 2001

(30) Foreign Application Priority Data

May 30, 2001 (TW) ..... 90208910 U

(51) Int. Cl.[7] ..... A44B 19/00
(52) U.S. Cl. ..... 24/421; 24/418; 24/424
(58) Field of Search ..... 24/418, 419, 424, 24/420–423, 429, 433, 436

(56) References Cited

U.S. PATENT DOCUMENTS 4,679,281 A * 7/1987 Ishii et al. ..... 24/419
5,255,418 A * 10/1993 Chen ..... 24/419
5,544,394 A * 8/1996 Yaguramaki ..... 24/424
5,551,129 A * 9/1996 Chu ..... 24/419
5,611,121 A * 3/1997 Akeno et al. ..... 24/419
5,625,927 A * 5/1997 Chu ..... 24/415
5,625,928 A * 5/1997 Terada et al. ..... 24/421
5,771,546 A * 6/1998 Minato ..... 24/419
5,809,622 A * 9/1998 Yaguramaki ..... 24/419
5,864,928 A * 2/1999 Matsushima ..... 24/419
6,314,624 B1 * 11/2001 Lin ..... 24/421

* cited by examiner

*Primary Examiner*—Robert J. Sandy
*Assistant Examiner*—André L. Jackson
(74) *Attorney, Agent, or Firm*—Rosenberg, Klein & Lee

(57) ABSTRACT

A zipper slide for invisible zipper is constructed to include a slide base, a hook plate, a spring element, a locating plate, and a pull tab, the slide base having a longitudinally extended partition block and a recessed receiving chamber in the partition block, the recessed receiving chamber having a hook hole, a first receiving space, a second receiving space and a retaining portion for the positioning of the hook plate and the spring element, the pull tab being coupled to the hook plate by a coupling ring, the slide base, the hook plate, the spring element and the connecting plate being fully automatically fastened together by an automatic stamping machine.

5 Claims, 7 Drawing Sheets

STRUCTURE OF ZIPPER SLIDE FOR INVISIBLE ZIPPER

BACKGROUND OF THE INVENTION

The present invent relates to a zipper slide for invisible zipper and, more particularly to an improved structure of zipper slide for invisible zipper, which is assembled fully automatically by a stamping machine to save labor cost.

FIG. 1 shows a zipper slide for invisible zipper according to the prior art. This structure of zipper slide 1 comprises a slide base 10, a swivel hook plate 11, a spring 12, and a pull tab 13. The hook plate 11 has a middle part pivoted to the slide base 10 by a rivet 111. The pull tab 13 is coupled to one end of the hook plate 11. The spring 12 is mounted in the slide base 1 and connected between a part of the slide base 1 and the one end of the hook plate 11. This structure of zipper slide 1 is functional. However, because the hook plate 11 is pivotally connected to the slide base 10 by the rivet 111, the assembly of the zipper slide consumes much labor and, cannot be achieved by a fully automatic machine.

SUMMARY OF THE INVENTION

The present invention has been accomplished to provide a zipper slide for invisible zipper, which eliminates the aforesaid drawback. It is the main object of the present invention to provide a zipper slide for invisible zipper, which is assembled fully automatically by a stamping machine to save labor consumption and to reduce the manufacturing cost. According to the present invention, the zipper slide for invisible zipper comprises a slide base having a longitudinally extended partition block and a recessed receiving chamber in the partition block, the recessed receiving chamber of the partition block comprising a hook hole, a receiving space, and a retaining portion, a hook plate mounted in a recessed receiving chamber in the partition block of the slide base, the hook plate having a hooked tip hooked in the hook hole of the partition bloc and a bottom butt positioned in the receiving space of the partition block, a spring element mounted in the slide base, the spring element having one end fastened to the retaining portion of the partition block and an opposite end pressed on a top face of the hook plate to hold down the hook plate in position, a locating plate fixedly fastened to the slide base, and a pull tab coupled to a hooked tip of the hook plate by a coupling ring. The slide base, the hook plate, the spring element and the connecting plate are fully automatically fastened together by a stamping machine.

DETAILED DESCRIPTION OF THE PREFERRED EMBODIMENT

Figure 1:
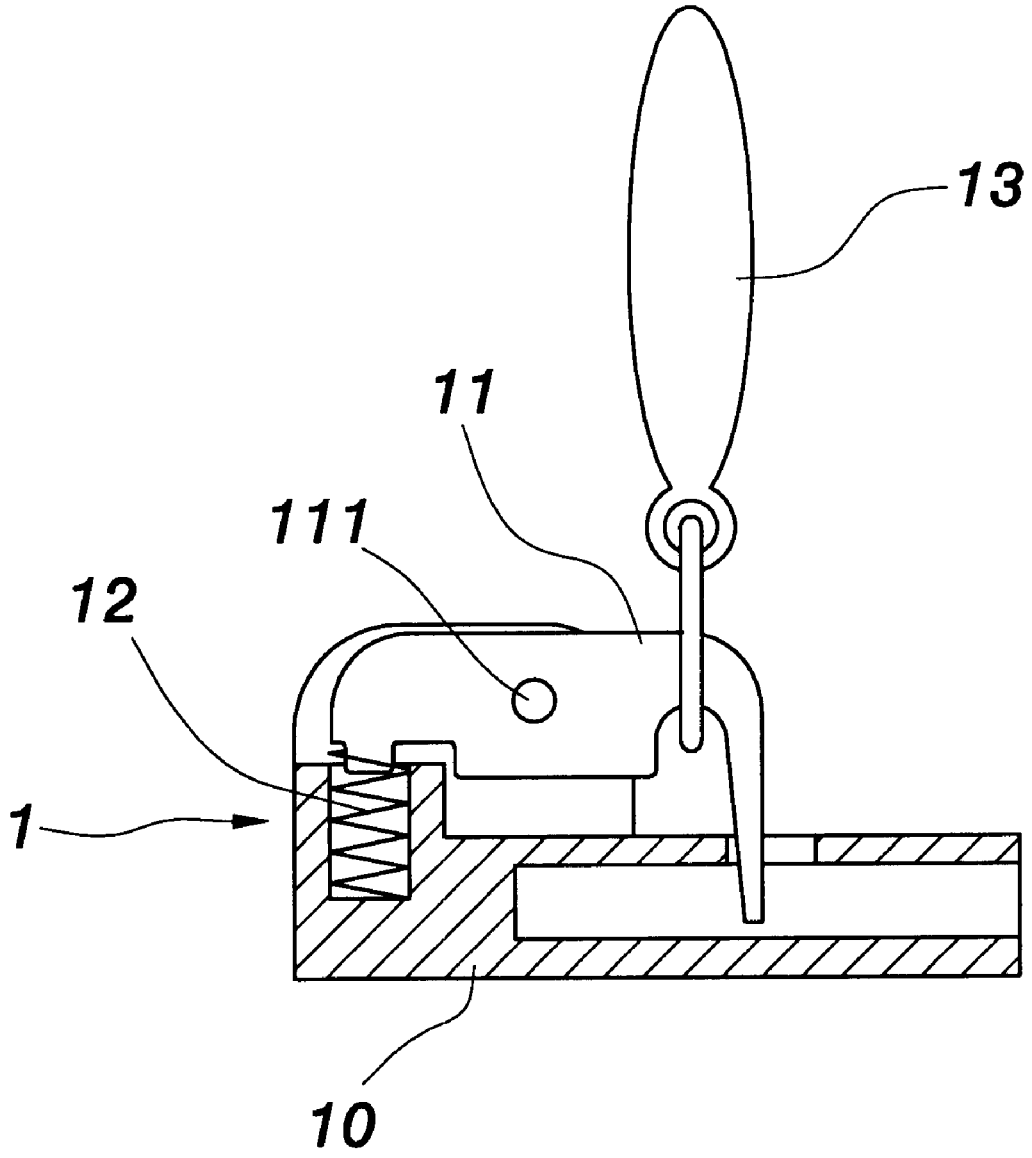
FIG. 1 PRIOR ART
FIG. 1 is a sectional assembly view of a zipper slide for invisible zipper constructed according to the prior art.
Figure 2:
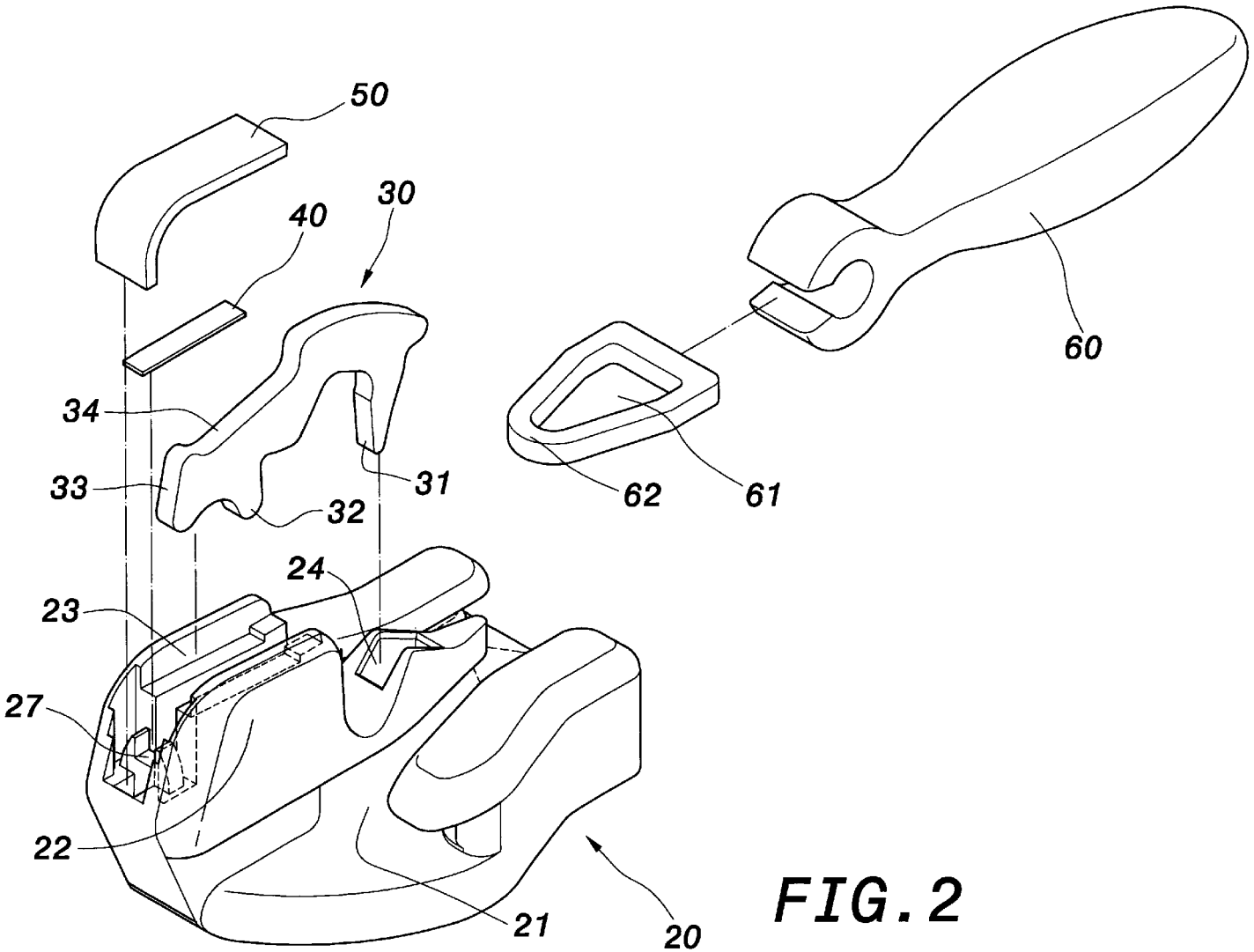
FIG. 2 is an exploded view of a zipper slide for invisible zipper constructed according to the present invention.

Referring to FIGS. from 2 through 4, a zipper slide 70 for invisible zipper in accordance with the present invention is shown comprising a slide base 20, a hook plate 30, a spring element 40, a locating plate 50, and a pull tab 60. An automatic machine to save labor cost assembles the zipper slide 70.

The slide base 20 is made of metallic material, for example, aluminum alloy or zinc alloy, comprising two parallel guide ways 21, which receive the respective zipper tapes (not shown) and have a respective rear part disposed in communication with each other, and a longitudinally extended upright partition block 22, which separates the guide ways 21. The upright partition block 22 comprises a recessed receiving chamber 23, which receives the hook plate 30.

Referring to FIGS. from 2 through 4 again, the recessed receiving chamber 23 of the partition block 22 comprises a hook hole 24, a first receiving space 25, a second receiving space 26 disposed below the hook hole 24, and a retaining portion 27.

Figure 4:
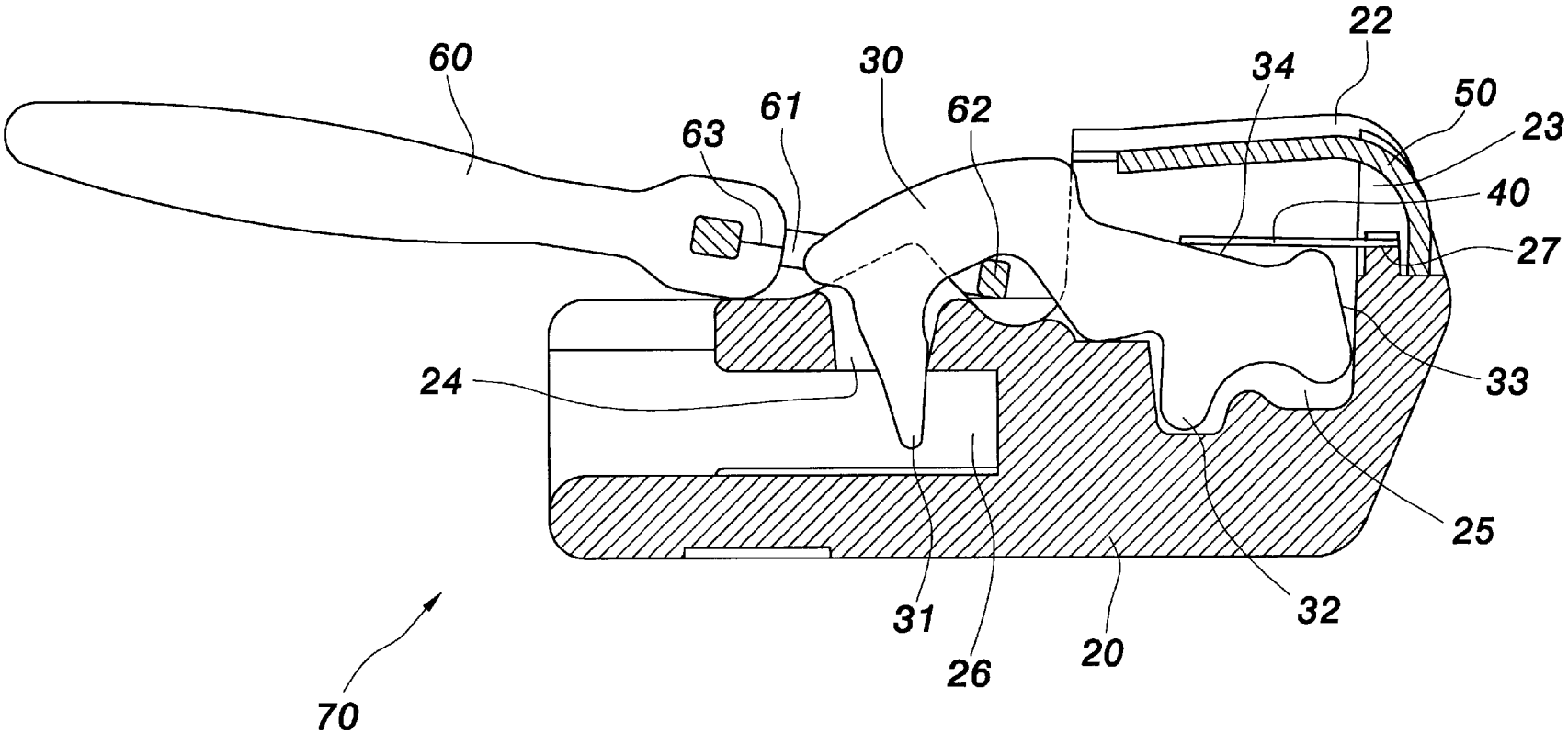
FIG. 4 is a side view in section of FIG. 3.
Figure 5:
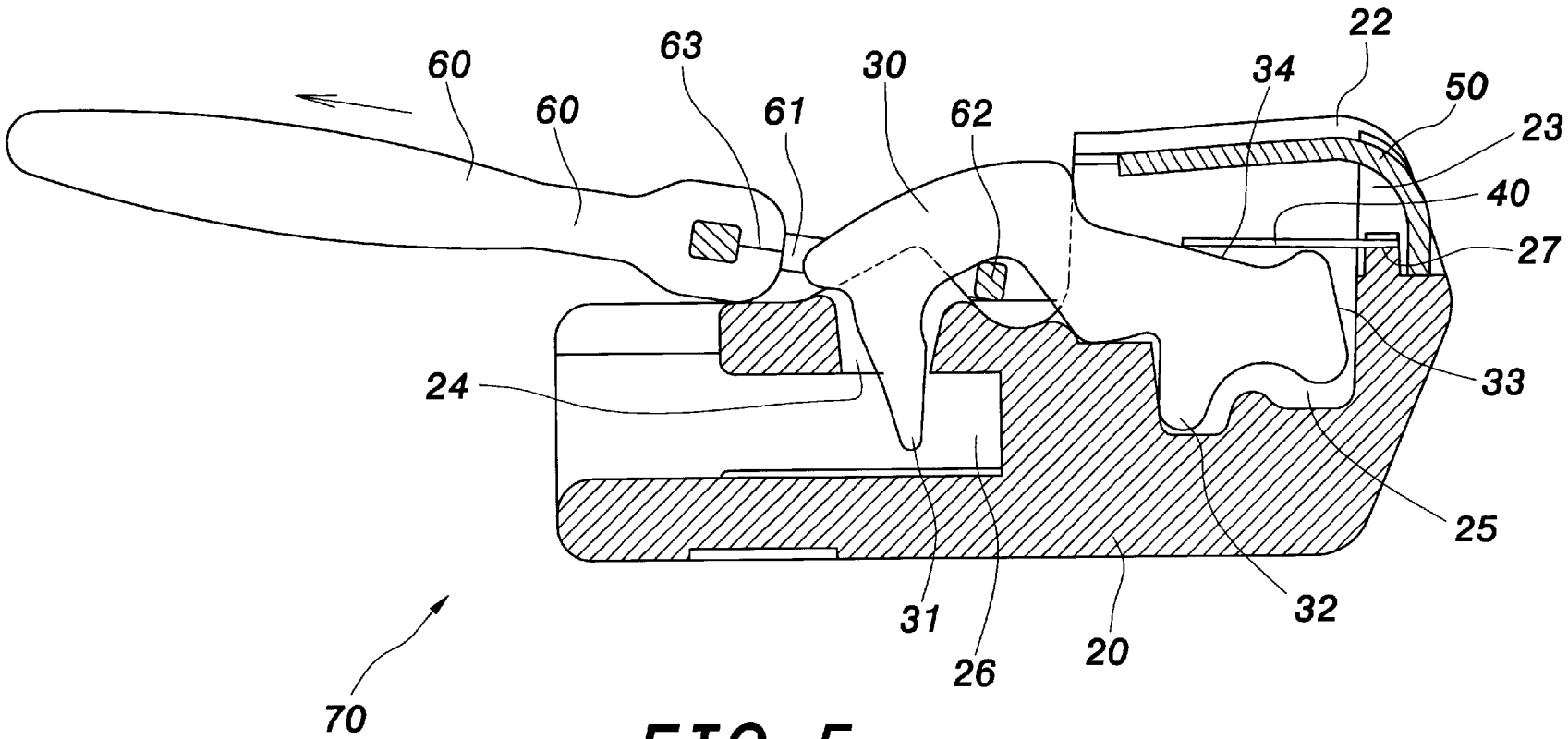
FIG. 5 is a sectional view showing the action of the present invention (I).
Figure 6:
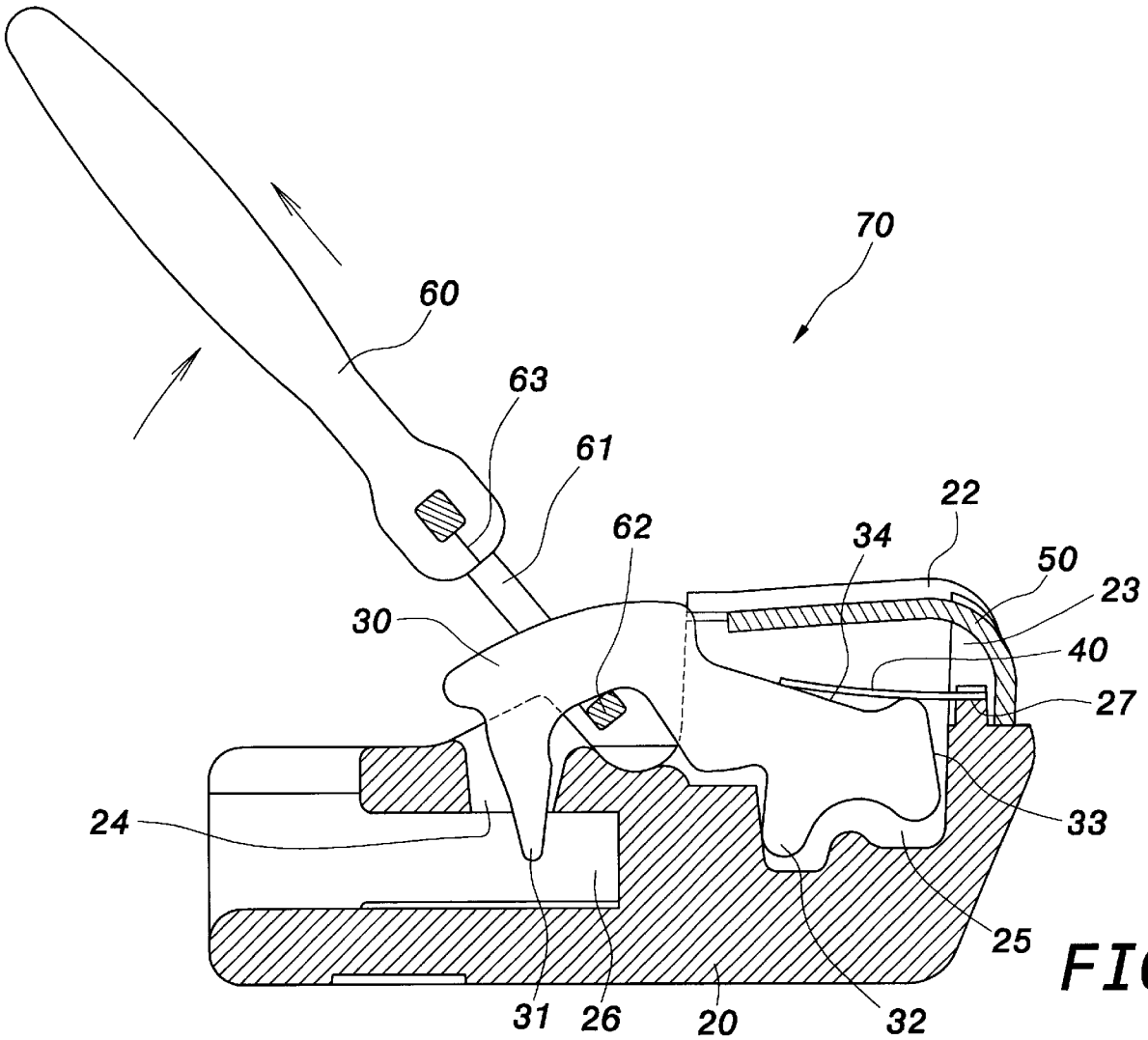
FIG. 6 is a sectional view showing the action of the present invention (II).
Figure 7:
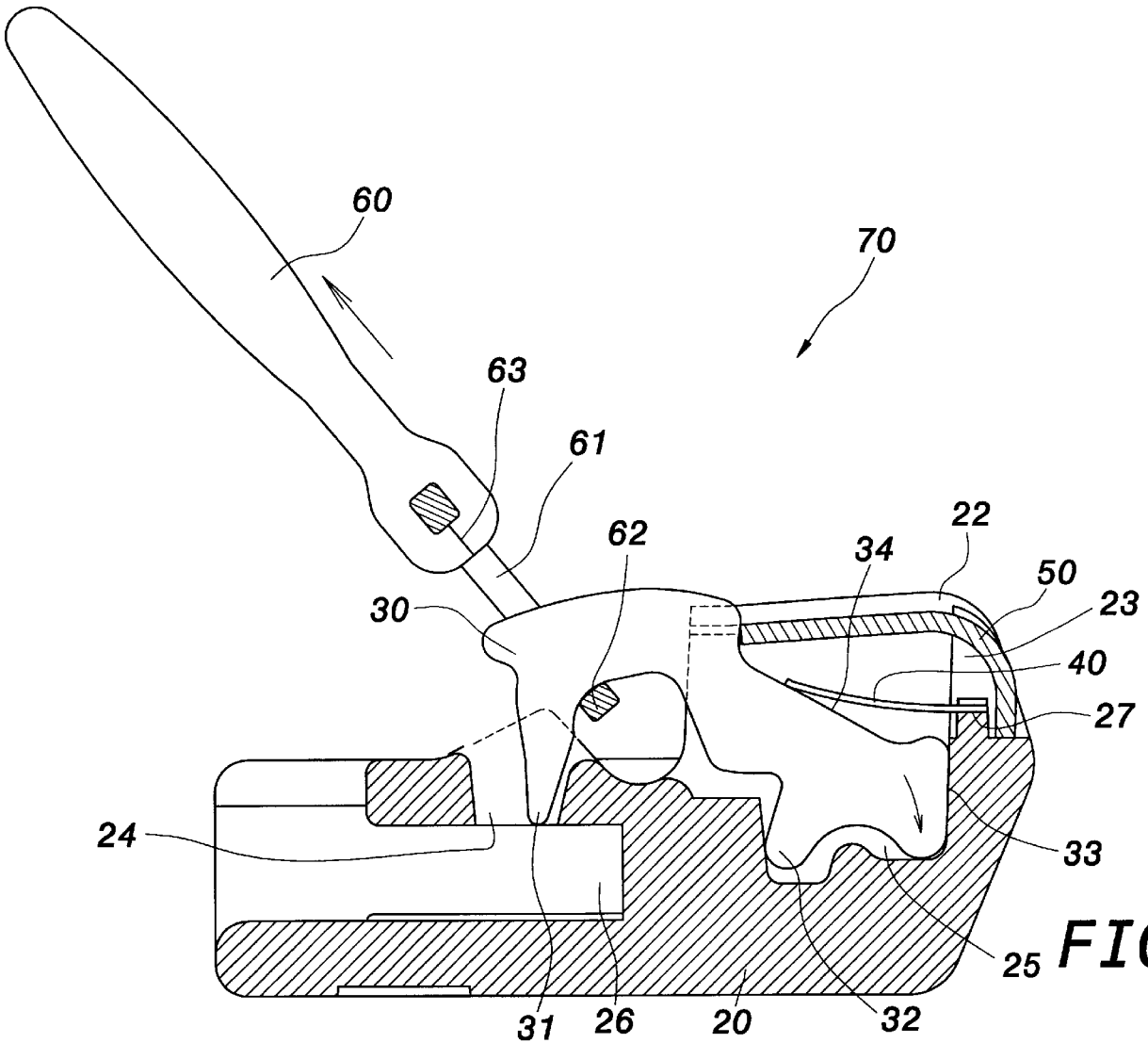
FIG. 7 is a sectional view showing the action of the present invention (III).

The hook plate 30 is made of metallic material, for example, aluminum alloy or zinc alloy, comprising a hooked tip 31 extended from one end thereof and inserted through the hook hole 24 into the second receiving space 26 of the recessed receiving chamber 23 of the partition block 22 of the slide base 20, a bottom butt 32 supported in the first receiving space 25 of the recessed receiving chamber 23 of the partition block 22 of the slide base 20 (see FIG. 4), a bearing portion 33 extended from an opposite end thereof and stopped against a part of the peripheral wall of the first receiving space 25 of the recessed receiving chamber 23 of the partition block 22 of the slide base 20, and a top face 33 adapted to support the spring element 40.

Figure 3:
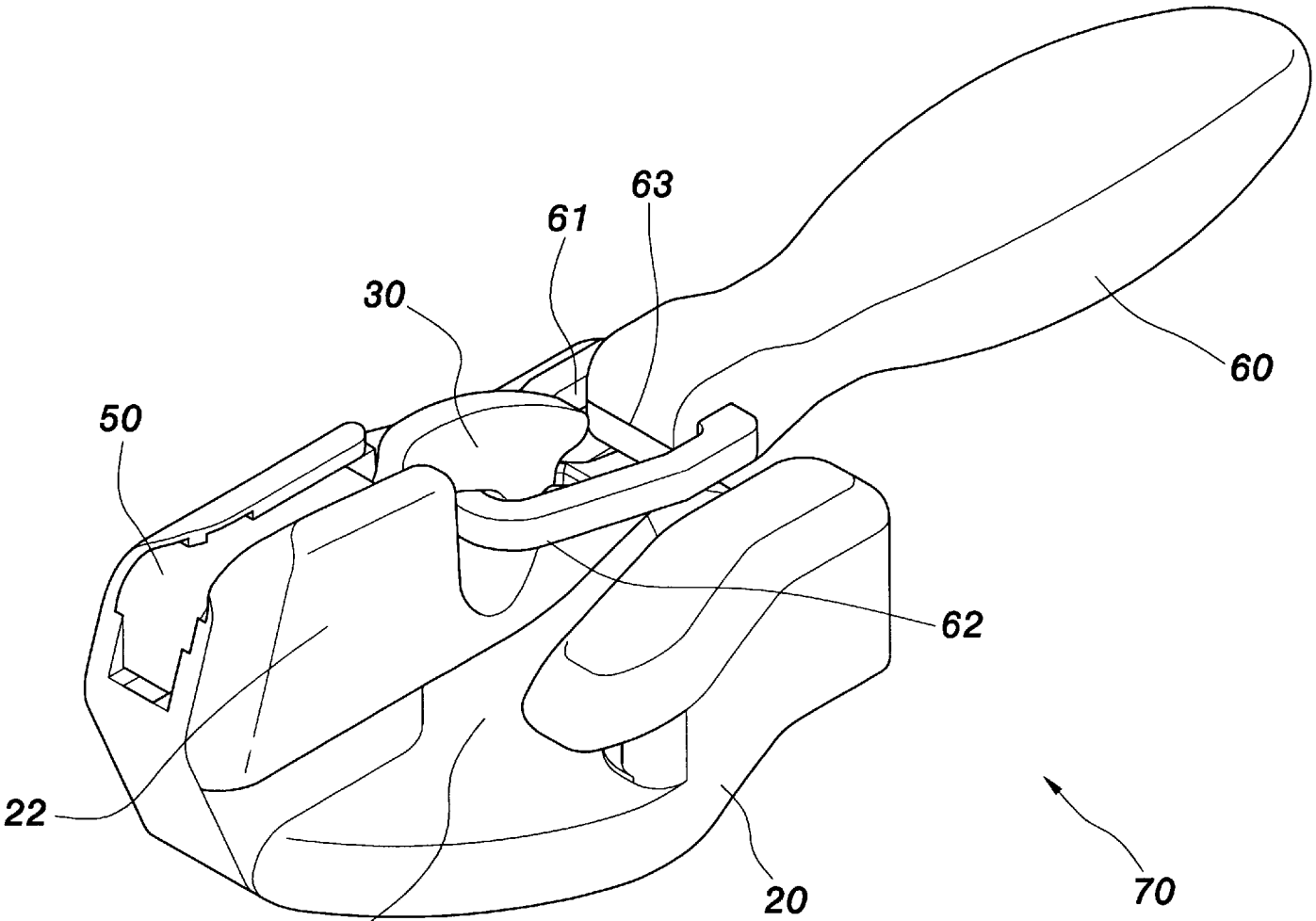
FIG. 3 is an elevational assembly view of the zipper slide for invisible zipper according to the present invention.

The pull tab 60 is made of metallic material, for example, aluminum alloy or zinc alloy, having a knuckle 63 at its one end to which a coupling ring 62 is pivoted for coupling the pull tab 60 to the hooked tip 31 of the hook plate 30. The coupling ring 62 defines a hole 61 through which the hooked tip 31 of the hook plate 30 passes. As indicated in FIG. 3, the coupling ring 62 couples the pull tab 60 to the hook plate 30. Further, the pull tab 60 can be marked with a trademark or logo.

The spring element 40 may be variously shaped. According to the preferred embodiment of the present invention, the spring element 40 is a flat spring plate. Alternatively, the spring element 40 can be a curved clamping plate or U-shaped spring plate. When installed, the spring element 40 has one end fixedly connected to the retaining portion 27 of the recessed receiving chamber 23 of the partition block 22, and the other end pressed on the top face 33 of the hook plate 30 to hold the hook plate 30 in position, keeping the hooked tip 31 of the hook plate 30 hooked in the hook hole 24 of the slide base 20 (see FIG. 4).

The locating plate 50 is made of made of metallic material, for example, aluminum alloy or zinc alloy, and fixedly fastened to the recessed receiving chamber 23 of the partition block 22 of the slide base 20 at a top side. The locating plate 50, the slide base 20, the spring element 40 and the hook plate 30 are fixedly fastened together by stamping (see FIG. 3).

Referring to FIGS. from 5 through 7, when pulling the pull tab 60 forward, the bottom butt forms a pivot about which the hook plate rotates to displace the hook tip within the hook hole, the bearing portion 33 is forced against the peripheral wall of the first receiving space 25 of the recessed receiving chamber 23 of the partition block 22 of the slide base 20, the top face 34 of the hook plate 30 is stopped against one end of the locating plate 50, and the hooked tip

31 of the hook plate 30 is hooked in the hook hole 24, and therefore the slide base 20 is positively moved with the pull tab 60 relative to the zipper tapes being received in the guide ways 21. When stopped from pulling the pull tap 60, the spring power of the spring element 40 forces the hook plate 30 downwards, thereby causing the hooked tip 31 of the hook plate 30 to be engaged into the second receiving space 26 of the recessed receiving chamber 23 of the partition block 22 of the slide base 20 again.

According to the present invention, the slide base 20, the hook plate 30 and the spring element 40 are fastened together by stamping. Because the assembly process of the zipper slide 70 eliminates manual riveting, the manufacturing cost of the zipper slide 70 is low.

A prototype of zipper slide for invisible zipper has been constructed with the features of FIGS. 2~7. The zipper slide for invisible zipper functions smoothly to provide all of the features discussed earlier.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. A zipper slide for an invisible zipper comprising:

a slide base, said slide base having a longitudinally extended upright partition block, said upright partition block comprising a recessed receiving chamber, said recessed receiving chamber comprising a hook hole, a receiving space, and a retaining portion;

a hook plate displaceably mounted in said slide base, said hook plate comprising a hooked tip extended from one end thereof and extending into said hook hole of said recessed receiving chamber, a bearing portion formed on an opposing end and extending into said receiving space of said recessed receiving chamber, a bottom butt disposed intermediate said hooked tip and said bearing portion and supported in the receiving space of said recessed receiving chamber, and a top face disposed at a top face of said hook plate, said bottom butt forming a pivot about which said hook plate rotates to displace said hooked tip within said hook hole;

a flat spring plate having one end fixedly connected to said retaining portion of said recessed receiving chamber and an opposing end pressed against said top face of said hook plate for holding said hook plate within said recessed receiving chamber and biasing said hook plate to position said hooked tip to extend through said hook hole;

a locating plate fixedly fastened to the recessed receiving chamber of said partition block of said slide base;

a coupling ring coupled to the hooked tip of said hook plate, said coupling ring defining a hole through which the hooked tip of said hook plate passes; and a pull tab coupled to the hole of said coupling ring.

2. The zipper slide for invisible zipper of claim 1 wherein said slide base, said hook plate and said spring element are fastened together by stamping.

3. The zipper slide for invisible zipper of claim 1 wherein said slide base comprises two parallel guide ways separated by said partition block and adapted to receive a respective zipper tape.

4. The zipper slide for invisible zipper of claim 1 wherein said recessed receiving chamber of said partition block of said slide base further comprises a second receiving space disposed below and in communication with said hook hole and adapted to receive said hooked tip of said hook plate.

5. The zipper slide for invisible zipper of claim 1 wherein said pull tab has one end terminating in a knuckle coupled to said coupling ring.

* * * * *